US006533018B2

(12) United States Patent
Anderson et al.

(10) Patent No.: US 6,533,018 B2
(45) Date of Patent: Mar. 18, 2003

(54) SYSTEM FOR HOLDING BATTERIES IN A HEADRAIL FOR POWERED COVERINGS FOR ARCHITECTURAL OPENINGS

(75) Inventors: Richard N. Anderson, Whitesville, KY (US); Donald E. Fraser, St. Petersburg, FL (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/093,286

(22) Filed: Mar. 6, 2002

(65) Prior Publication Data

US 2002/0088561 A1 Jul. 11, 2002

Related U.S. Application Data

(63) Continuation of application No. 09/480,912, filed on Jan. 11, 2000, now Pat. No. 6,382,294.

(60) Provisional application No. 60/138,743, filed on Jun. 11, 1999, provisional application No. 60/126,104, filed on Mar. 25, 1999, and provisional application No. 60/115,393, filed on Jan. 11, 1999.

(51) Int. Cl.[7] ..... E06B 9/30

(52) U.S. Cl. ..... 160/178.1 R; 160/168.1 R; 160/176.1 R

(58) Field of Search ..... 160/168.1 P, 176.1 P, 160/84.02, 188, 310, 178.1 R; 429/99, 100

(56) References Cited

U.S. PATENT DOCUMENTS

| | | | |
|---|---|---|---|
| 3,537,909 | A | 11/1970 | Horton |
| 4,623,012 | A | 11/1986 | Rude et al. |
| 4,758,824 | A | 7/1988 | Young |
| 4,943,498 | A | 7/1990 | Cooper et al. |
| 4,951,730 | A | 8/1990 | Hsu |
| 5,228,491 | A | 7/1993 | Rude et al. |
| 5,404,090 | A | 4/1995 | Shinbori |
| 5,413,161 | A | 5/1995 | Corazzini |
| 5,433,035 | A | 7/1995 | Bauer |
| 5,495,153 | A | 2/1996 | Domel et al. |
| 5,662,154 | A | 9/1997 | Drake, III |
| 5,825,289 | A | 10/1998 | Riordan |
| 6,062,290 | A | 5/2000 | Domel |

FOREIGN PATENT DOCUMENTS

| | | |
|---|---|---|
| AU | 76262/91 | 11/1991 |
| CA | 2162443 | 5/1996 |
| DE | 82239134 | 1/1983 |
| DE | 29508479 | 9/1995 |
| GB | 2076454 | 9/1983 |
| NZ | 161962 | 2/1972 |

*Primary Examiner*—Blair M. Johnson
(74) *Attorney, Agent, or Firm*—Dorsey & Whitney LLP

(57) ABSTRACT

A system for holding batteries in a headrail comprises a battery carrier that cooperates with a battery carrier housing through an opening in the bottom of a headrail housing. The battery carrier accommodates a plurality of batteries and slidingly engages the battery carrier housing, which is mounted within the interior of the headrail housing. Since the battery carrier is slidably and removably engaged with the battery carrier housing, it is possible to remove and replace batteries without disassembling the headrail.

15 Claims, 12 Drawing Sheets

SYSTEM FOR HOLDING BATTERIES IN A HEADRAIL FOR POWERED COVERINGS FOR ARCHITECTURAL OPENINGS

CROSS-REFERENCE TO RELATED APPLICATIONS

This application is a continuation of U.S. application Ser. No. 09/480,912, filed Jan. 11, 2000, now U.S. Pat. No. 6,382,294, entitled "System for Holding Batteries in a Headrail for Powered Coverings for Architectural Openings," which is related and claims priority to U.S. provisional application No. 60/115,393, filed Jan. 11, 1999 and entitled "Window Blind with Motorized Tilt Control"; and No. 60/126,104, filed Mar. 25, 1999 and entitled "Motorized Blind." It is also related and claims priority to U.S. provisional application No. 60/138,743, filed Jun. 11, 1999 and entitled "Headrail Including a Detachable Battery Holder for Powered Coverings for Architectural Openings." The present application is also related to U.S. application Ser. No. 09/481,237, filed Jan. 11, 2000 and entitled "Headrail Including a Detachable Battery Holder for Powered Coverings for Architectural Openings," pending; application Ser. No. 09/480,913, filed Jan. 11, 2000, now U.S. Pat. No. 6,371,192, entitled "Headrail, Including a Trap Door for Accessing Batteries for Powered Coverings for Architectural Openings"; application Ser. No. 09/481,746, filed Jan. 11, 2000, now U.S. Pat. No. 6,410,908, entitled "Fiber Optic Signal-Receiving System Removably Connected to a Headrail Housing"; and application Ser. 09/481,307, filed Jan. 11, 2000, now U.S. Pat. No. 6,446,693, entitled "Headrail and Control System for Powered Coverings for Architectural Openings." Each of these related applications (namely, the '912, '393, '104, '743, '237, '913, '746, and '307 applications) is hereby incorporated by reference as though fully set forth herein.

BACKGROUND OF THE INVENTION a. Field of the Invention

The instant invention is directed toward a system for holding batteries in a headrail for powered coverings for architectural openings. More specifically, it relates to a system that permits access to batteries for a battery-powered adjustable covering for an architectural opening without the need to completely disassemble the headrail.

b. Background Art

It is well known to use adjustable coverings over architectural openings. Such adjustable coverings include cellular panels, Venetian blinds, and many other mechanisms for controlling the passage of light, vision, or air through the architectural openings. For example, cellular panels and Venetian blinds may be adjusted by retracting or extending them, and Venetian blinds may be adjusted by tilting the slats. Depending upon the specific type of mechanism, other adjustments are possible.

It is also known in the art to power these adjustable coverings. For example, electric motors may be used in connection with the adjustable coverings to facilitate retracting the coverings or otherwise adjusting the coverings to control the amount of light, vision, or air that may pass through the coverings. It is also known in the art to use battery-powered electric motors, particularly in applications where access to an electrical outlet or other electrical wiring may not exist. In applications where access to the covering may be limited, it is also know to use remote controls to operate the electric motors that allow a user to selectively configure the covering. For example, when adjustable coverings are used in connection with elevated architectural openings, it may be quite inconvenient to manually change the configuration of the coverings.

When an adjustable covering is battery powered, it is challenging to design an aesthetically pleasing system wherein the battery or batteries are convenient to the electric actuators they power. To design an attractive battery-powered adjustable covering, it is preferable that the battery or batteries are located within the headrail and thereby hidden from view. Placing the battery or batteries within the headrail, however, can make it difficult to change the batteries as they become depleted.

SUMMARY OF THE INVENTION

The system of the present invention has been designed such that a battery or batteries for a powered adjustable covering for an architectural opening are conveniently hidden within a headrail housing and accessible for removal and replacement. The system preferably comprises a battery carrier and a battery carrier housing. The battery carrier and the battery carrier housing cooperate through an elongated opening in a bottom wall of the headrail housing. Once the batteries are placed in the battery carrier, the battery carrier is slid through the elongated opening, and the battery carrier is then retained by the battery carrier housing mounted above the elongated opening.

In a form of the system of the present invention for holding a plurality of batteries in a headrail housing, a battery carrier housing is mounted to the headrail housing above an elongated opening in a bottom wall of the headrail housing. A battery carrier is slidably mounted in the battery carrier housing by inserting the battery carrier through the elongated opening and into the battery carrier housing.

In another form of present invention, the system for holding a plurality of batteries in a headrail housing includes an elongated opening through a bottom wall of the headrail housing, a battery carrier housing, and a battery carrier. The battery carrier housing is mounted to the headrail housing, above the elongated opening. The battery carrier is thus substantially or fully contained within the headrail housing. The battery carrier includes a plurality of battery ports, one for each battery, into which the batteries are loaded. After the batteries are loaded, the battery carrier is then slidably mounted in the battery carrier housing. In a preferred form of the present invention, the battery carrier housing is removably mounted to the headrail housing, and the battery carrier is removably mounted to the battery carrier housing.

In yet another form of the invention, the headrail housing further includes a front wall having a bottom edge comprising a flange. A ledge extends rearwardly from the flange. The battery carrier has a lower edge with a discontinuous retention foot along it. When the battery carrier is fully installed in the battery carrier housing, the discontinuous retention foot rides on the ledge.

DESCRIPTION OF THE PREFERRED EMBODIMENT

Figure 1:
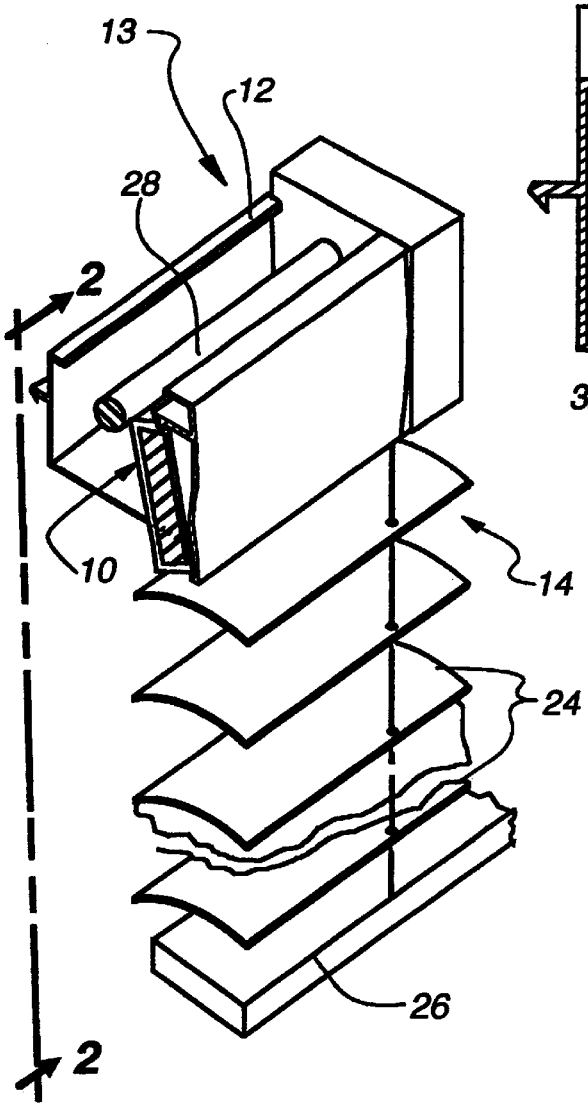
FIG. 1 is a fragmentary isometric view showing the front and top of a headrail, adjustable covering, and bottom rail for an architectural opening.

A preferred embodiment of a system for holding batteries 10 in a housing 12 of a headrail 13 for a battery-powered adjustable covering 14 for an architectural opening is disclosed. In the present invention, a battery carrier 16 cooperates through an elongated opening 18 in the headrail housing 12 with a battery carrier housing 20 to conveniently hold one or more batteries 22 within the headrail housing 12. An advantage of the present invention over the prior art is that batteries 22 are hidden within the headrail housing 12 and thereby hidden from view, yet easily accessible without completely disassembling the headrail 13.

Figure 2:
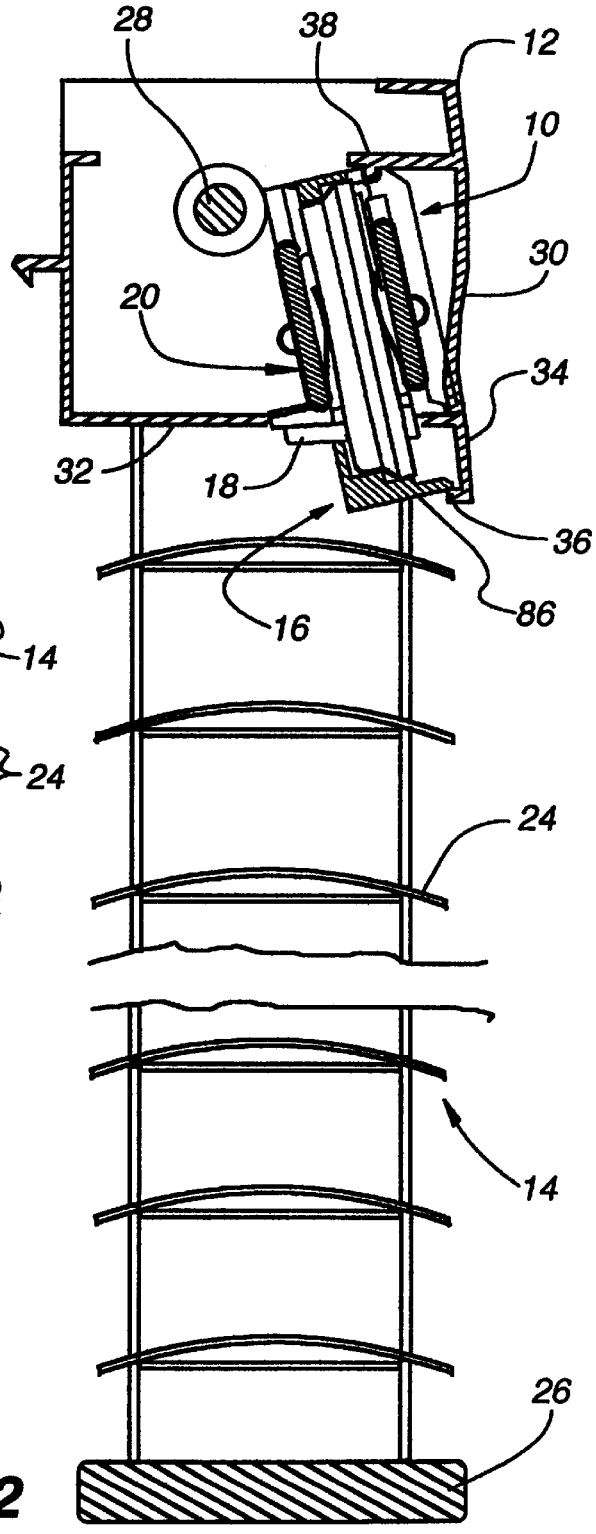
FIG. 2. is a fragmentary cross-sectional view taken along line 2—2 of FIG. 1, depicting the battery-holding system of the present invention.

Referring first to FIGS. 1 and 2, the battery holding system 10 of the present invention is shown in position within the housing 12 of the headrail 13. In FIG. 1, an adjustable covering 14 comprising slats 24 is shown for context. The adjustable covering 14 is mounted between the headrail 13 and a bottom rail 26. As shown in FIGS. 1 and 2, the headrail 13 includes the housing 12 that conceals various components comprising part of a control system. For example, a tilt rod 28 is mounted within the housing 12 shown in FIGS. 1 and 2. The control system facilitates adjustment of the adjustable covering 14. For example, the control system may allow retraction or extension of the adjustable covering 14, or, if the adjustable covering includes slats 24 as shown in FIGS. 1 and 2, the control system may allow the slats 24 to be pivoted about their longitudinal axes to control the amount of light or air that may pass through the adjustable covering 14.

Figure 3:
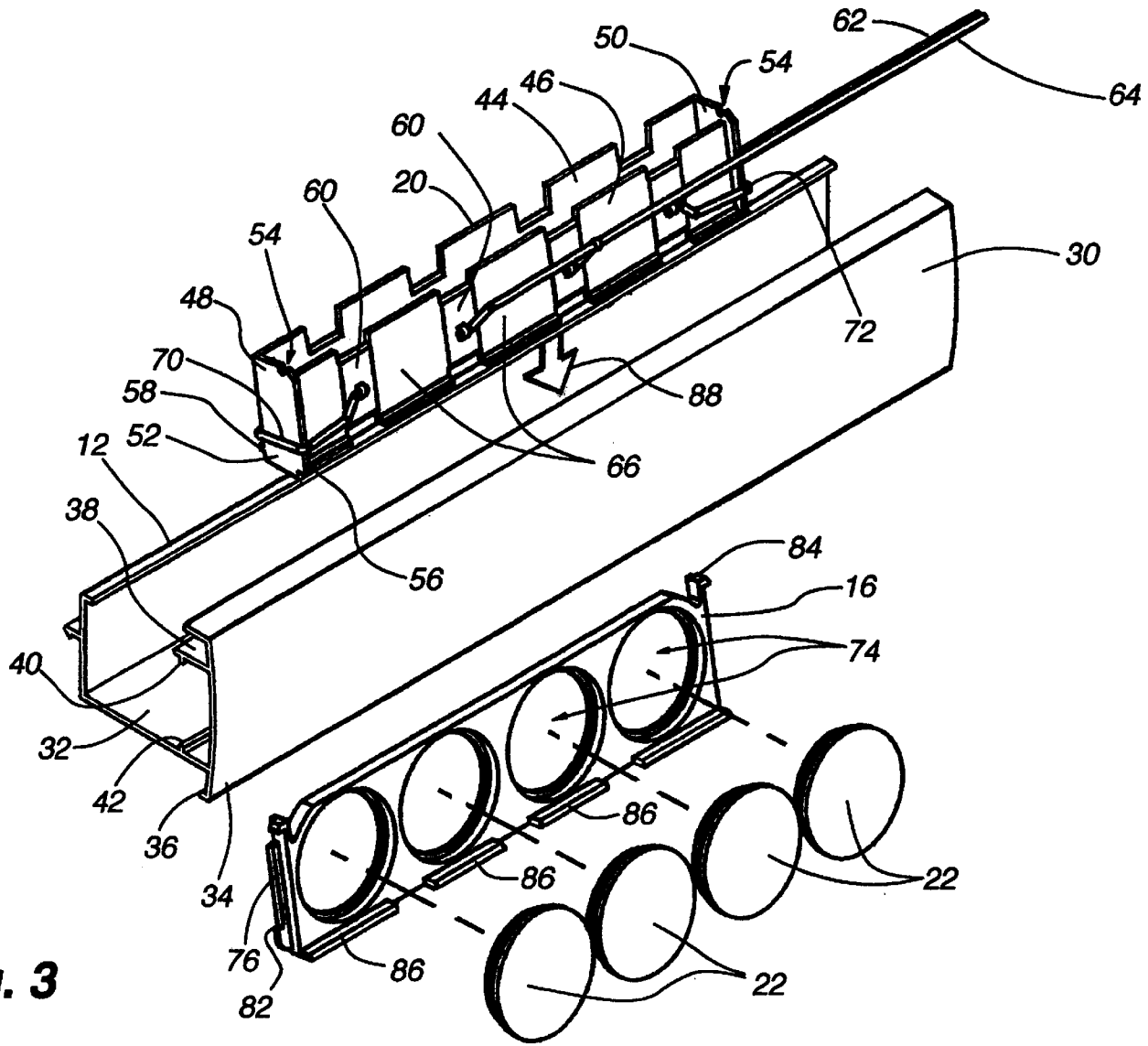
FIG. 3 is an exploded, fragmentary isometric view of the front, top, and left end of a headrail housing and the system for holding batteries according to the present invention.
Figure 4:
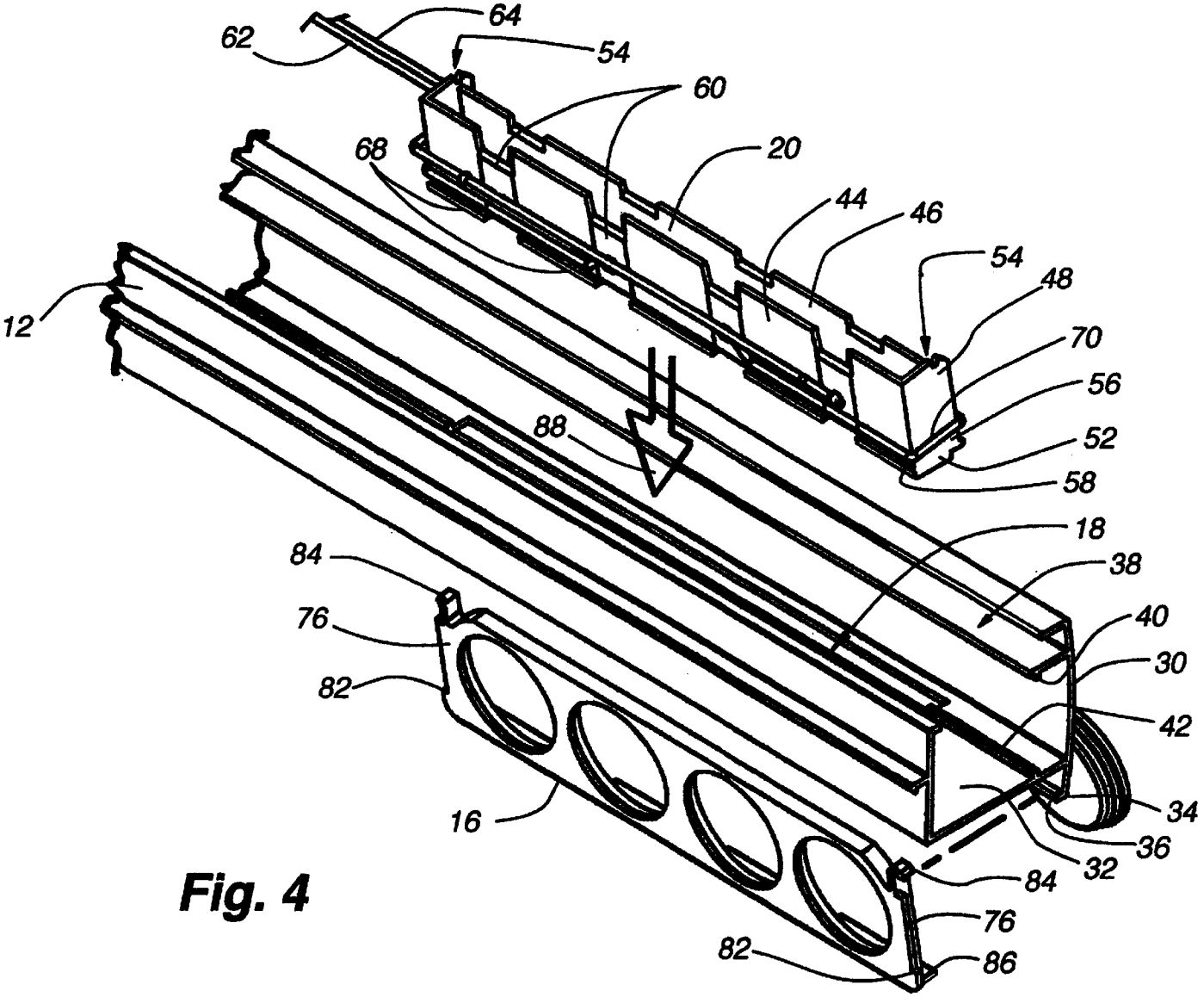
FIG. 4 is similar to FIG. 3, but depicts the back, top, and left end of the headrail housing and the system for holding batteries according to the present invention.

As shown clearly in FIGS. 2–4, among others, the housing 12 includes a front wall 30 and a bottom wall 32. The front wall 30 may have one of myriad cross-sectional shapes. For example, the front wall 30 depicted in FIG. 2 is somewhat S-shaped in cross-section, whereas the front wall 30 in the remaining figures is comprised of an arc of a circle. In the preferred embodiment, the lower edge of the front wall 30 comprises a flange 34 that extends below the bottom wall 32 of the housing 12. A ledge 36 extends rearwardly from the lowest edge of the flange 34 in the preferred embodiment. As will be described further below, this substantially horizontal ledge 36 at the lowest edge of the flange 34 helps to maintain the battery carrier 16 in position. As shown to good advantage in each of FIGS. 2–4, a carrier housing retainer ledge 38 extends rearwardly from the front wall 30 and into the interior of the housing 12. A ridge 40 extends longitudinally from an underside of the carrier housing retainer ledge 38. As described further below, this ridge 40 helps keep the battery carrier housing 20 in position within the headrail housing 12. A rib 42 extends upwardly from the bottom wall 32 into the interior of the headrail housing 12. This rib 42, which extends longitudinally along the interior of the headrail housing 12, is interrupted by the elongated opening 18 (FIG. 4). As described further below, the rib 42 helps position the battery carrier housing 20 above the elongated opening 18 when the battery carrier housing 20 is in position over the elongated opening 18.

Referring most particularly to FIGS. 3, 4, 11, and 12, important features of the battery carrier housing 20 are described next. As shown to good advantage in FIGS. 3 and 4, the battery carrier housing 20 comprises a rear wall 44, a front wall 46, a left end wall 48, and a right end wall 50. The left and right end walls 48, 50 are mirror images of each other. Each of the end walls 48, 50 includes an extended portion 52 along its bottom edge. This extended portion 52 fits into the elongated opening 18 in the bottom wall 32 of the headrail housing 12 as shown to good advantage in FIGS. 11 and 12. Along the top edge of each end wall 48, 50 is a retention groove 54. When the battery carrier housing 20 is in position within the headrail housing 12, the ridge 40 depending downwardly from the carrier housing retention ledge 38 snaps into the retention groove 54 in each end wall 48, 50 as shown to good advantage in FIGS. 11, 12, 13B–13D, and 14A–14C. Each end wall 48, 50 also includes a front foot 56 (depicted to best advantage in FIGS. 11 and 12) and a rear foot 58 (FIGS. 3 and 4).

Figure 8:
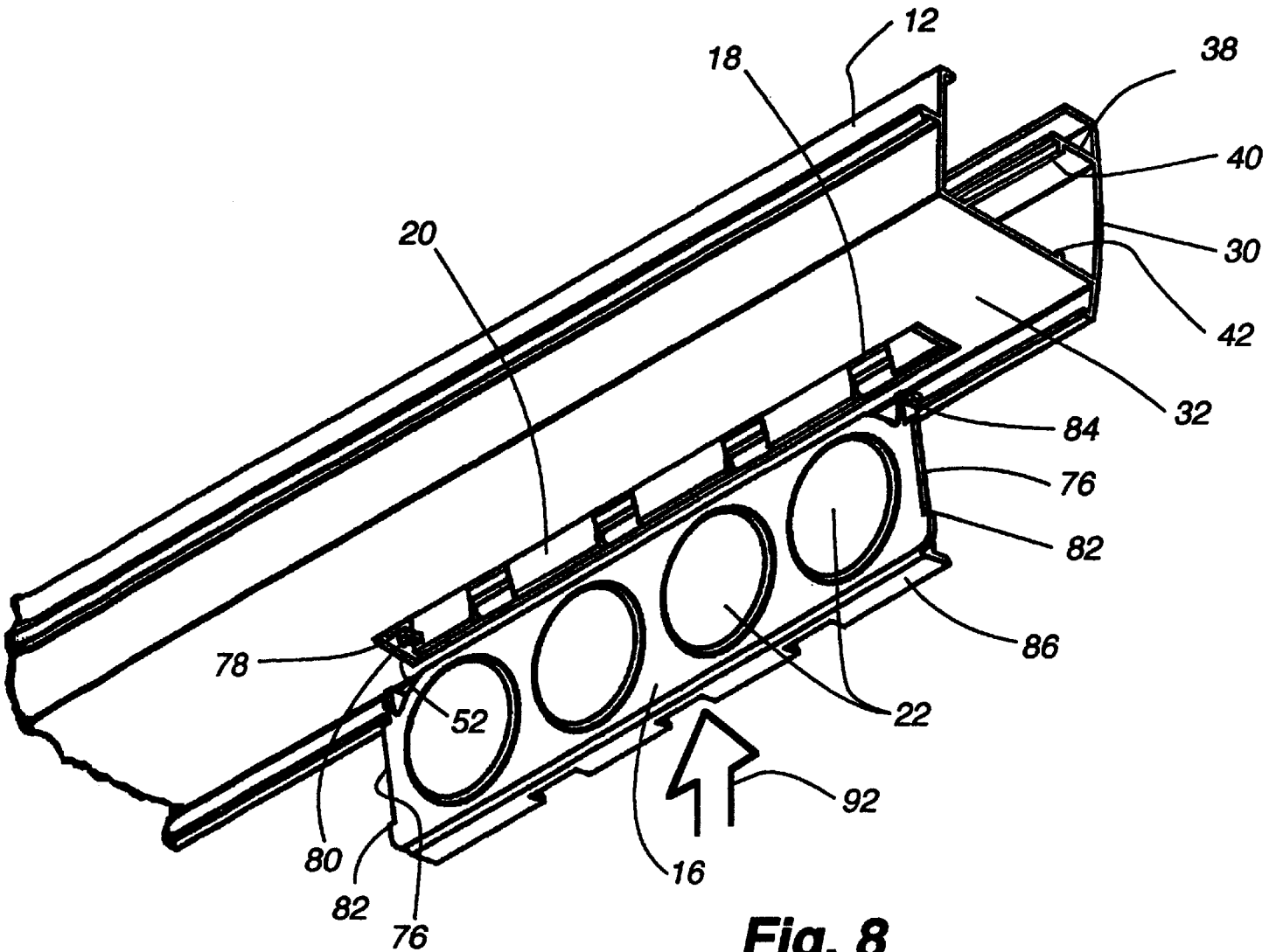
FIG. 8 is the same as FIG. 7, but depicts the bottom, back, and left end of the headrail housing and the system for holding batteries according to the present invention.
Figure 9:
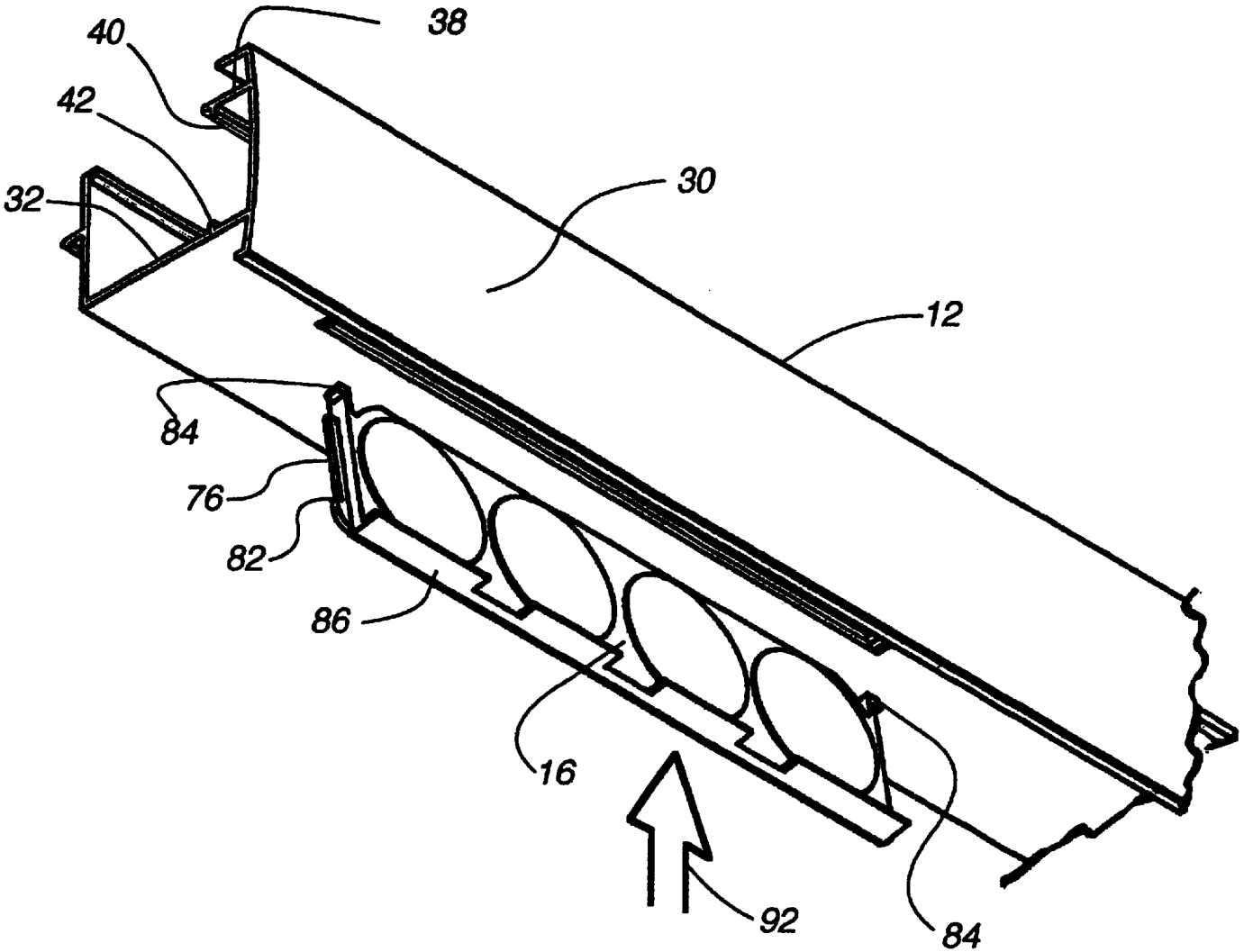
FIG. 9 is the same as FIG. 8, but depicts the front, bottom, and left end of the headrail housing and the system for holding batteries according to the present invention.
Figure 10:
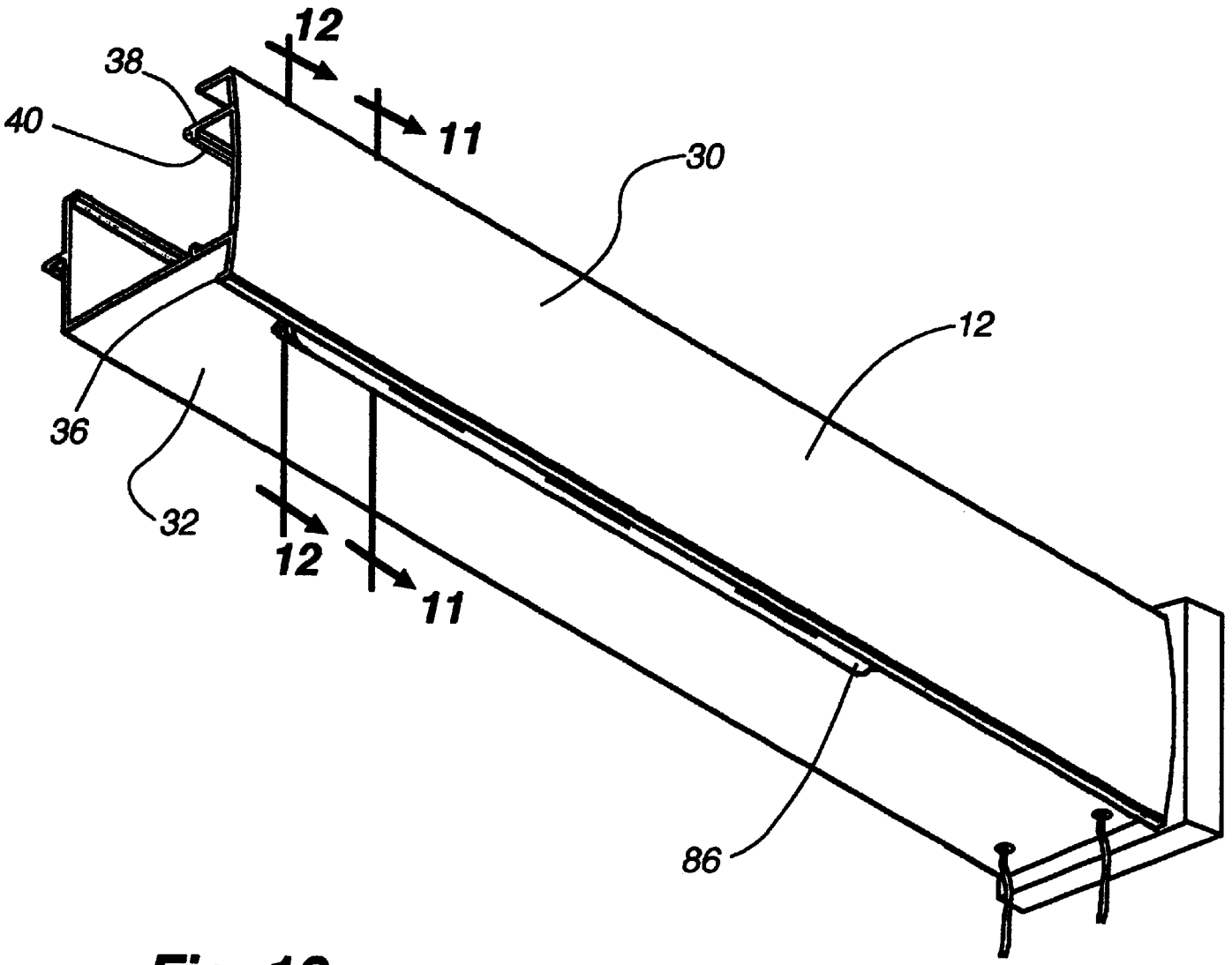
FIG. 10 is similar to FIGS. 1 and 2, but the adjustable covering has been removed for clarity, and the view depicts the front, bottom, and left end of the headrail housing and the system for holding batteries according to the present invention.
Figure 14A:
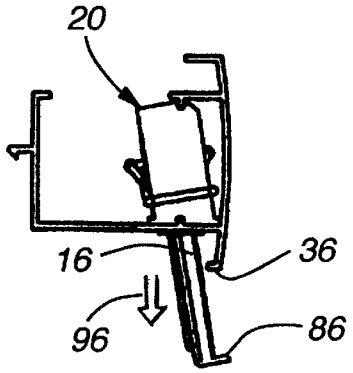
FIGS. 14A–14C are cross-sectional views depicting the steps taken to remove batteries from the battery carrier while the battery carrier housing remains in its mounted position within the headrail housing.
Figure 14B:
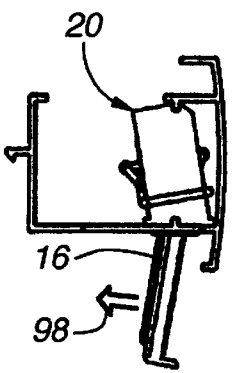
Figure 14C:
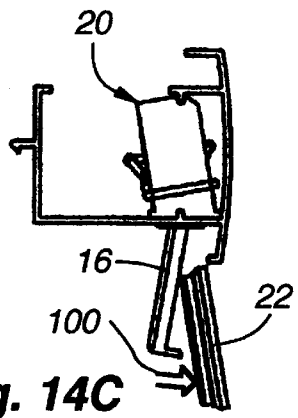

As shown to good advantage in FIGS. 3 and 4, the rear wall 44 of the battery carrier housing 20 is notched along its top and bottom surfaces. In the preferred installed. The stair-stepped nature of the battery ports 74 is clearly visible in, for example, FIGS. 3 and 11. A rib 76 is formed at each end of the battery carrier 16. As clearly shown in FIG. 12, for example, each rib 76 is guided between a rear carrier guide 78 and a front carrier guide 80, each of which extend from a wall 44 or 46 of the battery carrier housing 20. The front carrier guide 80 and the rear carrier guide 78 are also visible in FIG. 8. At the lower end of each rib 76 is a stop 82. These stops 82, as explained further below, prevent the battery carrier 16 from being inserted too far into the battery carrier housing 20 when batteries 22 are being loaded into their operational configuration. Also formed at an upper portion of each end of the battery carrier 16 is a hanger 84. These hangers 84 permit the battery carrier 16 to be pivoted slightly, as shown in FIGS. 14A–14C, during removal and replacement of batteries 22 when it is desirable not to fully remove the battery carrier 16 from the battery carrier housing 20.

Finally, as shown to good advantage in FIG. 3, a discontinuous retention foot 86 is formed along the bottom edge of the battery carrier 16. As clearly shown in FIGS. 2, 11, and 12, for example, the discontinuous retention foot 86 interacts with the ledge 36 on the bottom of the front wall flange 34 to retain the battery carrier 16 in the battery carrier housing 20. In the preferred embodiment, the retention foot 86 is discontinuous as shown in, for example, FIG. 3. This retention foot 86, however, could also be continuous or could comprise more or fewer sections than are depicted for the preferred embodiment.

Figure 11:
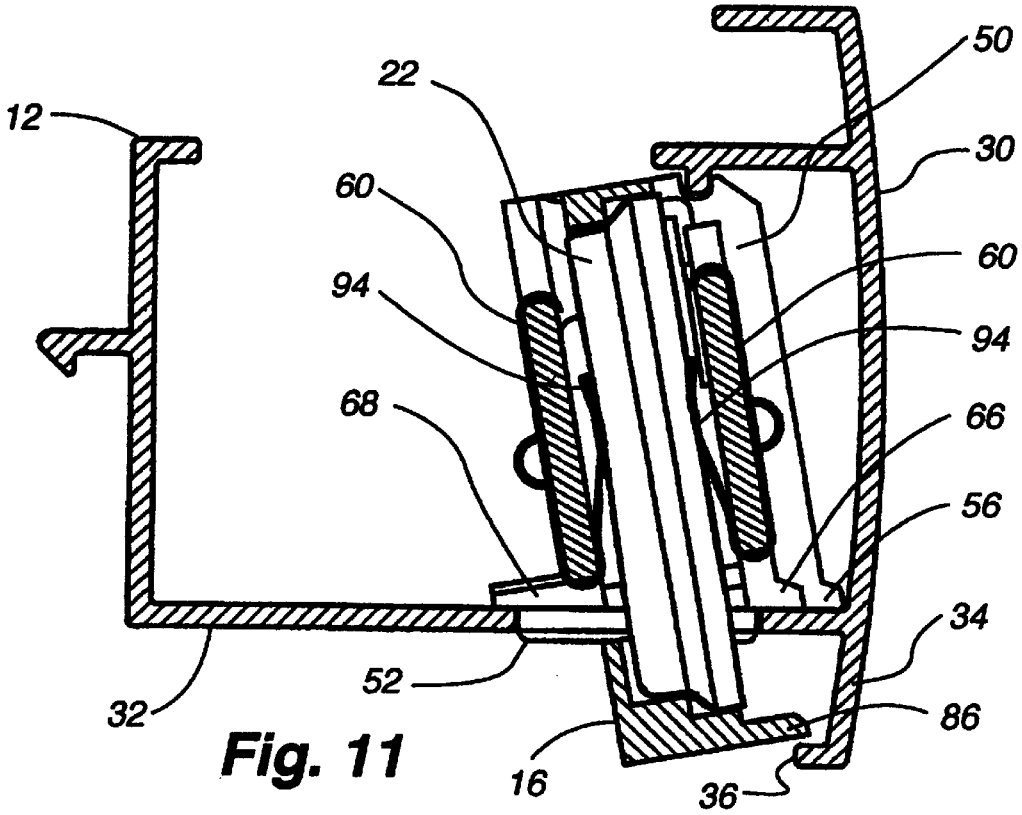
FIG. 11 is a cross-sectional view along line 11—11 of FIG. 10, depicting a battery in the battery carrier, and the battery carrier in position in the battery carrier housing.
Figure 12:
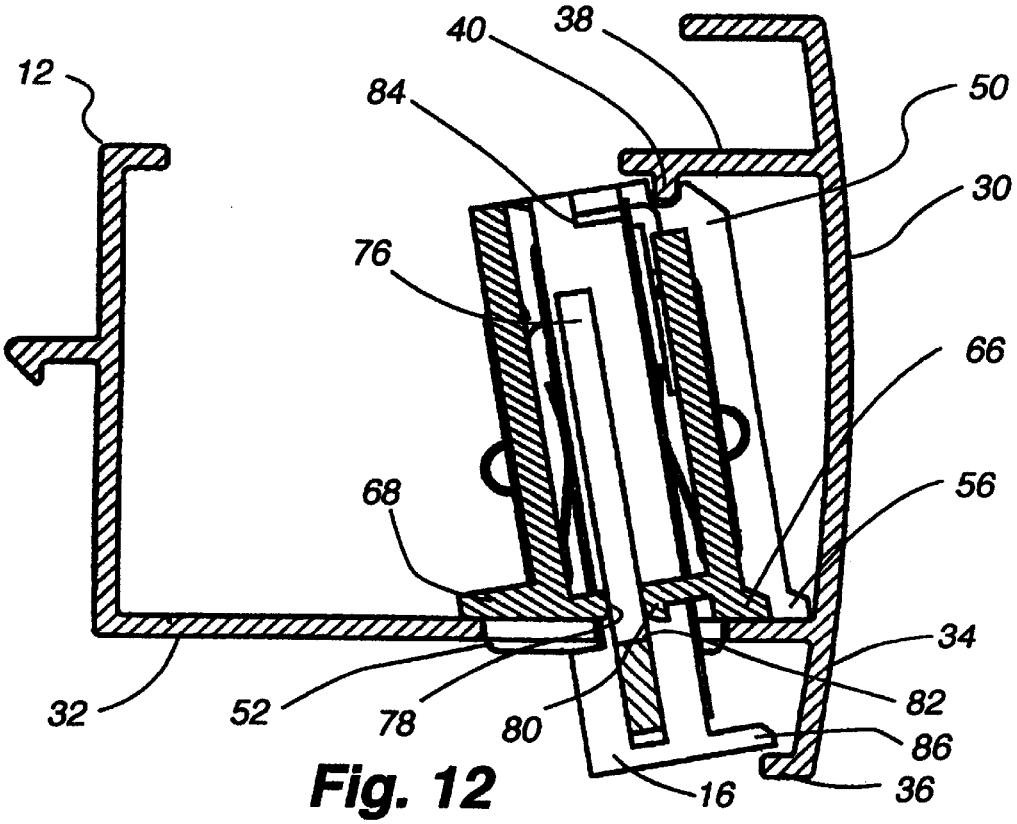
FIG. 12 is a cross-sectional view along line 12—12 of FIG. 10, depicting the interaction between a rib on the battery carrier and a front carrier guide and a rear carrier guide on the battery carrier housing.
Figure 13A:
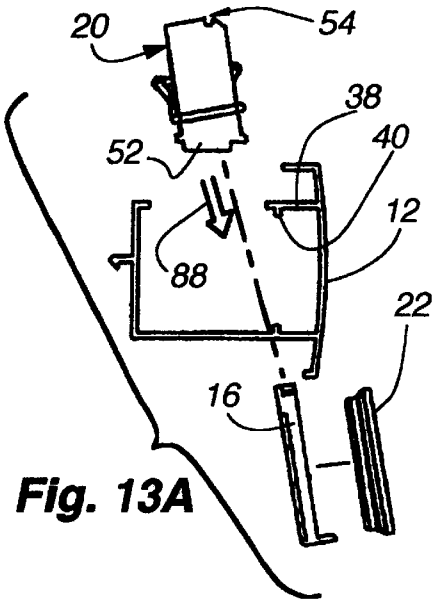
FIGS. 13A–13D are cross-sectional views showing the steps taken to install batteries into the headrail housing using the system for holding batteries according to the present invention.

Referring most particularly to FIGS. 13A–13D, assembly of the present system for holding batteries 10 in a headrail 13 is described next. FIG. 13A, which is a cross-sectional view most closely corresponding to FIGS. 3 and 4, depicts the battery carrier housing 20 before it is inserted into position in the headrail housing 12. Looking at FIGS. 3, 4, and 13A, assembly of the system for holding batteries 10 is commenced by inserting the battery carrier housing 20 into the headrail housing 12 along the path indicated by the arrow 88. In particular, the battery carrier housing 20 is inserted into the headrail housing 12 so that the extended portion 52 along the bottom edge of the left and right end walls 48, 50 of the battery carrier housing 20 line up with the short edges of the elongated opening 18 in the bottom wall 32 of the headrail housing 12. The battery carrier housing 20 is then seated in the headrail housing 12 by pushing the battery carrier housing 20 into the elongated opening 18 until the front foot 56 and rear foot 58 of the end walls 48, 50, as well as the elongated front foot 66 and rear foot 68 of the front and rear walls 46, 44, respectively, rest against the inside surface of the bottom wall 32 of the headrail housing 12. When the battery carrier housing 20 is properly inserted into the elongated opening 18 in the bottom wall 32 of the embodiment, the number of notches correspond with the number of batteries 22. Referring most particularly to FIG. 4, a clip-on conductor 60, which may also be seen to good advantage in FIG. 11, is mounted on the rear wall 44 of the battery carrier housing 20 at each notched region. The notched areas of the rear wall 44 thus provide mounting locations for the clip-on conductors 60 to keep the clip-on conductors 60 at a desired longitudinal spacing. As shown in FIGS. 3 and 4, the front wall 46 of the battery carrier housing 20 is similarly notched. Again, there are four notched areas along the front wall 46 since the preferred embodiment uses four batteries 22. As shown in FIG. 3, a clip-on conductor 60 is mounted to the front wall 46 at each of the notched locations. Thus, for each clip-on conductor 60 mounted to the rear wall 44 there is a corresponding clip-on conductor 60 mounted to the front wall 46. As described further below, these conductors 60 facilitate transfer of electrical energy from the batteries 22 to a first electrical lead 62 and a second electrical lead 64. As shown to good advantage in FIG. 3, at the bottom edge of each non-notched portion of the front wall 46, an elongated front foot 66 extends. Similarly, referring to FIG. 4, at iJ the bottom edge of each non-notched portion of the rear wall 44, an elongated rear foot 68 extends. These elongated front and rear feet 66, 68 may be seen in cross-section on FIG. 12.

As briefly mentioned above, first and second electrical leads 62, 64 are secured (e.g., soldered) to selected clip-on conductors 60. For example, as shown in FIG. 3, the second electrical lead 64 is soldered to the center two clip-on conductors 60. Also, as clearly shown in FIG. 4, the first electrical lead 62 is soldered to the endmost clip-on conductors 60. Looking at FIGS. 3 and 4 together, a first series connector 70 may be seen to connect a clip-on conductor 60 on the rear wall 44 of the battery carrier housing 20 to a clip-on conductor 60 mounted on the front wall 46 of the battery carrier housing 20. Similarly, a second series connector 72 connects an inboard clip-on conductor 60 mounted on the rear wall 44 to an end clip-on conductor 60 mounted on the front wall 46. As described below in connection with FIGS. 15–17, these connections comprise one method of connecting in parallel, battery pairs that are connected in series.

Referring to FIGS. 3 and 4, various features of the battery carrier 16 are described next. In the preferred embodiment, the battery carrier 16 accommodates four batteries 22. Thus, the battery carrier 16 has four battery ports 74 (two of which are labeled in FIG. 3) formed therethrough. Since the batteries 22 accommodated by the battery carrier 16 in the preferred embodiment are circular with a stair-stepped edge (see, e.g., FIG. 11), the four battery ports 74 are circumferentially stair-stepped to keep the batteries 22 from passing through the battery carrier 16 when they are housing 12, the longitudinal rib 42 extending upwardly from the bottom wall 32 rests against the outer surface of each end wall 48, 50 of the battery carrier housing 20, and the ridge 40 extending downwardly from the carrier housing retainer ledge 38 snaps into the retention grooves 54 formed along the top edges of the left and right end walls 48, 50. The battery carrier housing 20 is thereby securely, but removably, positioned within the headrail housing 12 above the elongated opening 18. This intermediate configuration is shown clearly in FIGS. 5, 6, and 13B.

Figure 5:
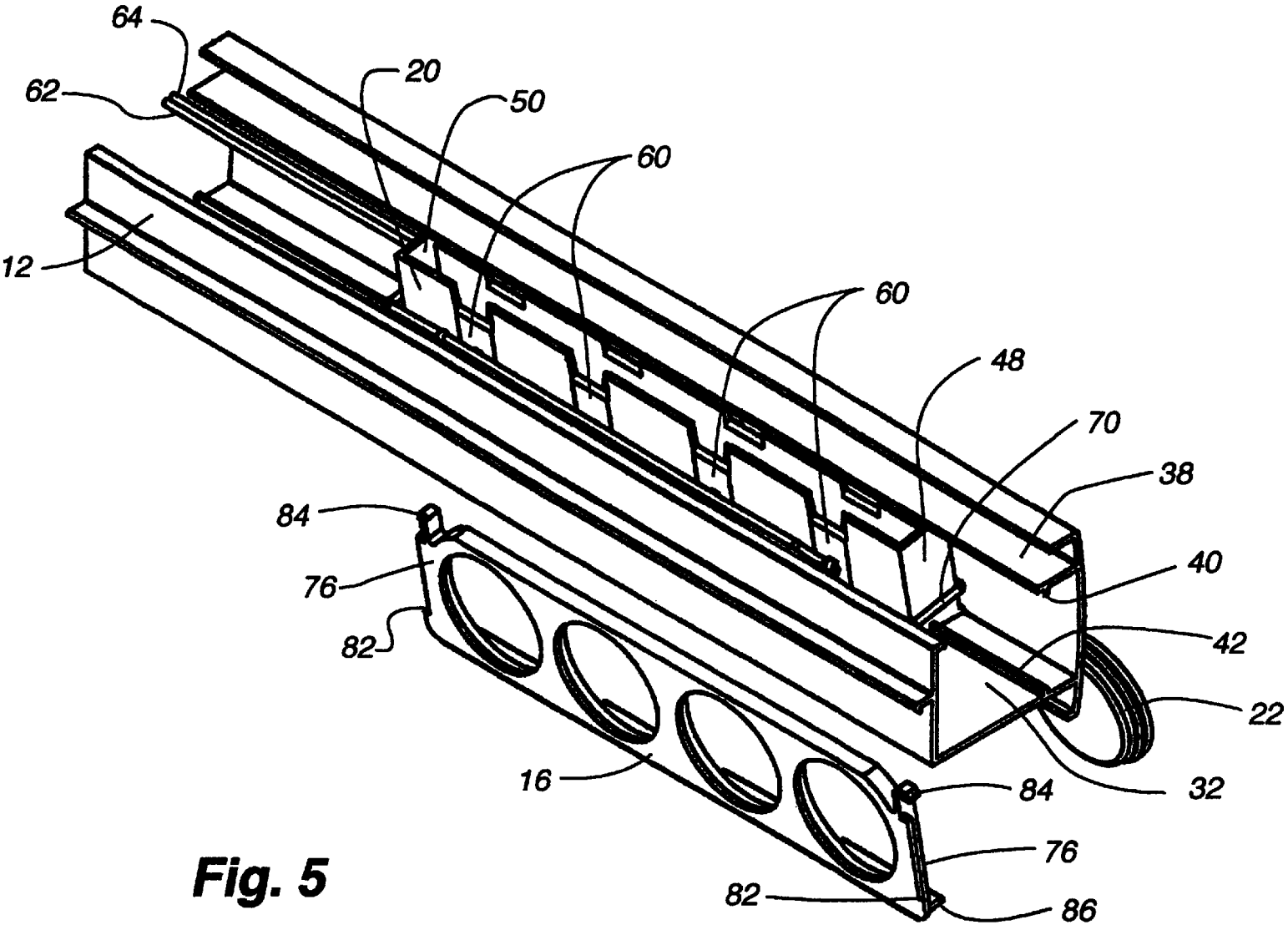
FIG. 5 is the same as FIG. 4, but depicts the battery carrier housing snapped into position within the headrail housing.
Figure 6:
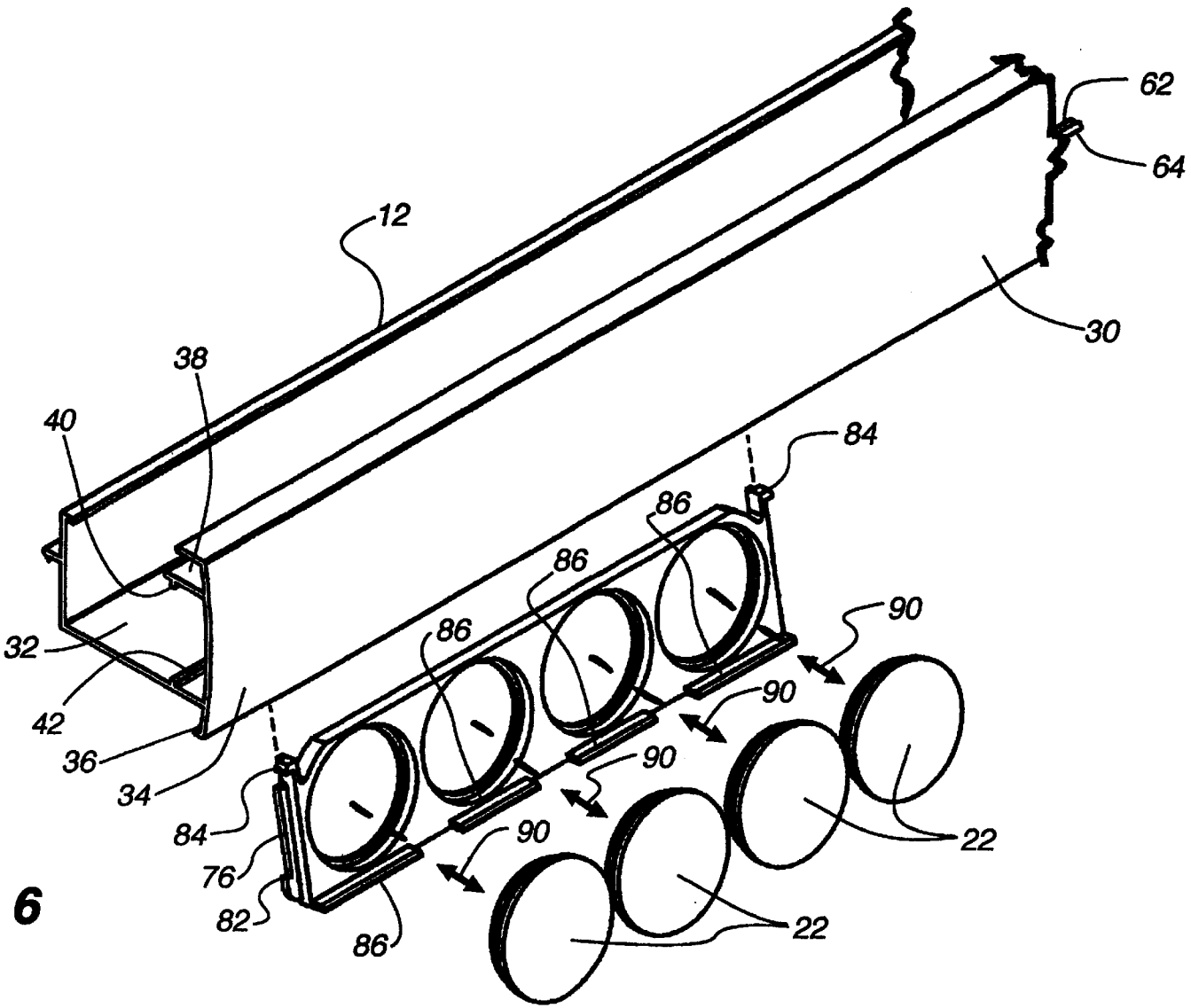
FIG. 6 is similar to FIG. 3, but shows the battery carrier housing snapped into position within the headrail housing.
Figure 7:
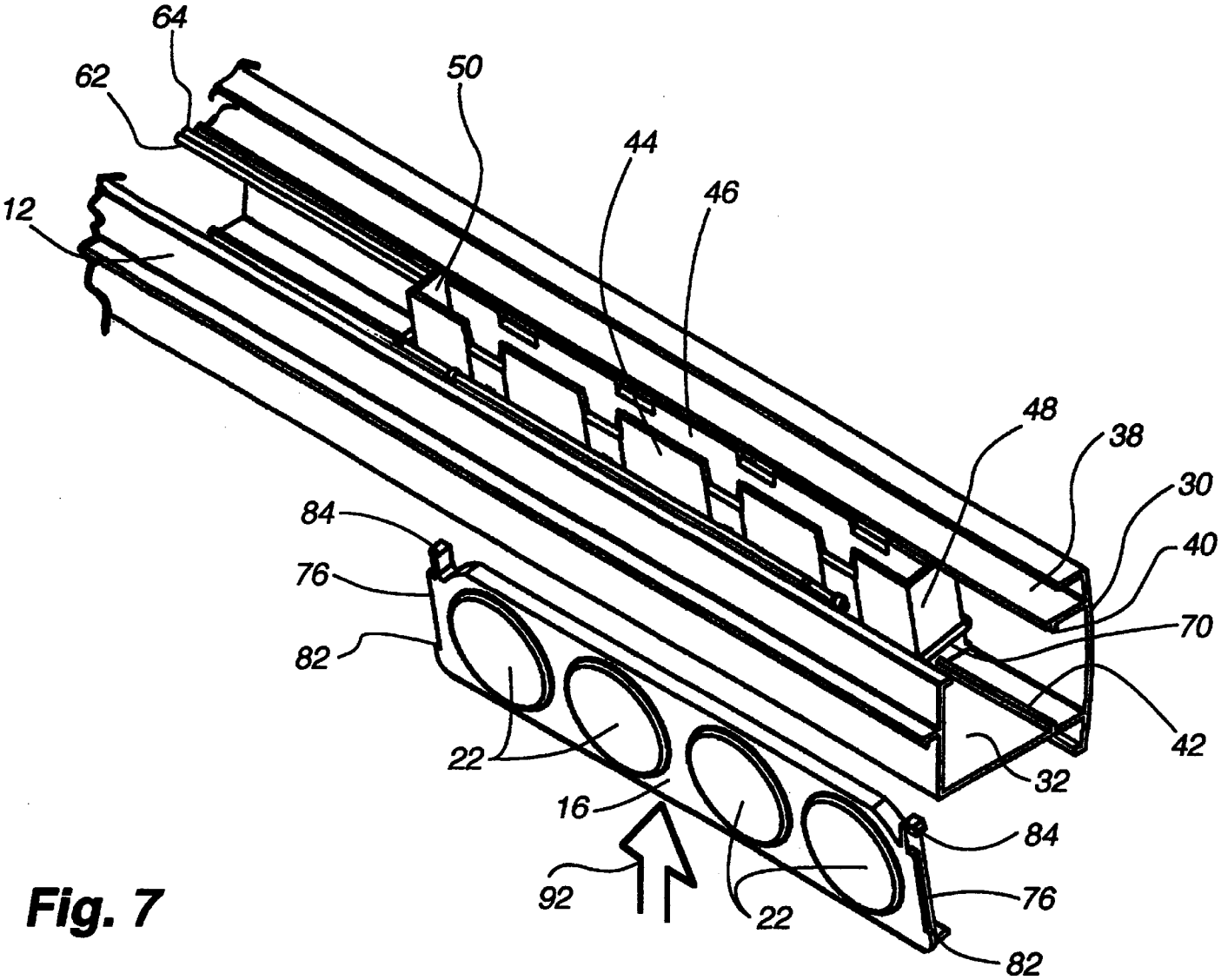
FIG. 7 is an isometric view similar to FIG. 5, but shows the batteries in position within the battery carrier.
Figure 13B:
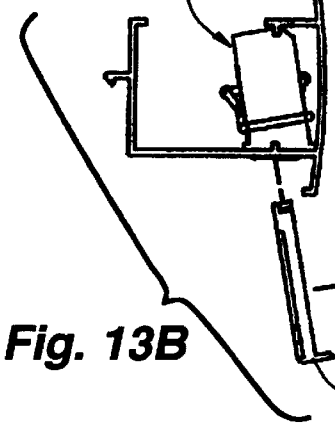
Figure 13C:
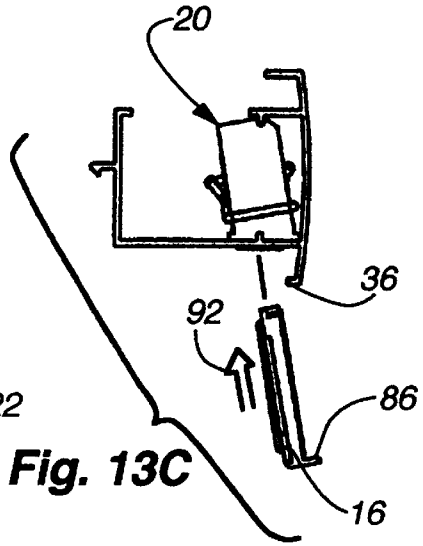
Figure 13D:
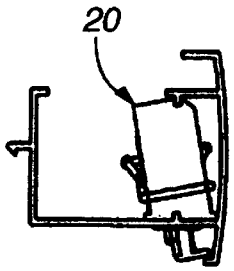

Referring next to FIGS. 5, 6, and 13B, the next step toward putting the system for holding batteries 10 into its operational configuration comprises inserting the batteries 22, in the direction of arrows 90, into the battery carrier 16. The battery-holding system 10 with the batteries 22 in position in the battery carrier 16, before the loaded battery carrier 16 is inserted into the battery carrier housing 20, is best depicted in FIGS. 7–9 and 13C.

After the batteries 22 are loaded into the battery carrier 16, the battery carrier 16 is pushed upward, in the direction of arrow 92, as shown in FIGS. 7–9 and 13C. As seen to best advantage in FIGS. 8 and 12, as the battery carrier 16 is pushed through the elongated opening 18 and into the mounted battery carrier housing 20, the ribs 76 on each end of the battery carrier 16 are guided between the rear carrier guide 78 and the front carrier guide 80. Initially, the hangers 84 extending outwardly from the upper edges of the battery carrier 16 must flex slightly inward to snap past the front and rear carrier guides 80, 78, respectively. To prevent the battery carrier 16 from excessive insertion into the battery carrier housing 20, the stops 82 formed near the lower end of each rib 76 on the battery carrier 16 impact the bottom wall 32 of the headrail housing 12. These stops 82 thereby prevent the battery carrier 16 from being inserted too far into the battery carrier housing 20.

Referring to FIGS. 10–12 and 13D, the fully loaded and assembled system for holding batteries 10 is shown. As shown to best advantage in FIGS. 11 and 12, which are cross-sectional views taken from FIG. 10, when the batteries 22 are loaded in the battery carrier 16, and the battery carrier 16 is fully installed in the battery carrier housing 20, the clip-on conductors 60 make appropriate electrical contact with the batteries 22 (FIG. 11). In particular, each clip-on conductor 60 includes a flexible connector 94 that is in close sliding, frictional engagement with one side of a battery 22.

Since one side of the battery 22 comprises a positive terminal and the other side of the battery 22 comprises a negative terminal, the clip-on conductors 60 mounted to the rear wall 44 make electrical connection with one set of battery terminals, while the clip-on conductors 60 attached to the front wall 46 make electrical contact with the other terminals of each battery 22.

Referring most particularly to FIGS. 14A–14C, removal and replacement of batteries 22 when it is desirable not to fully remove the battery carrier 16 from the battery carrier housing 20 is described next. As shown in FIG. 14A, the first step in the battery removal and replacement process is to slide the battery carrier 16 downward in the direction of arrow 96. By putting some rearward pressure on the lower portion of the battery carrier 16, adjacent the discontinuous retention foot 86 of the battery carrier 16, it is possible to slip the discontinuous retention foot 86 past the ledge 36 formed at the bottom edge of the front wall 30. Then, the battery carrier 16 may be slid further downward until the hangers 84 stop further downward movement. At this point, the batteries 22 in the battery carrier 16 are visible. As shown in FIG. 14B, the next step is to pivot the battery carrier 16 slightly rearwardly, in the direction of arrow 98, to provide room for battery removal. As shown in FIG. 14C, once the battery carrier 16 is pivoted slightly rearwardly, it is possible to remove dead or depleted batteries 22 from the battery carrier 16, pushing the batteries 22 in the direction of arrow 100, and to replace same with fresh batteries 22. Subsequently, the battery carrier 16 is pivoted forwardly to the configuration shown in FIG. 14A, and then pushed upwardly into the battery carrier housing 20 until the discontinuous retention foot 86 is again retained by the ledge 36 directed rearwardly from the bottom edge of the front wall 30 of the headrail housing 12.

Figure 15:
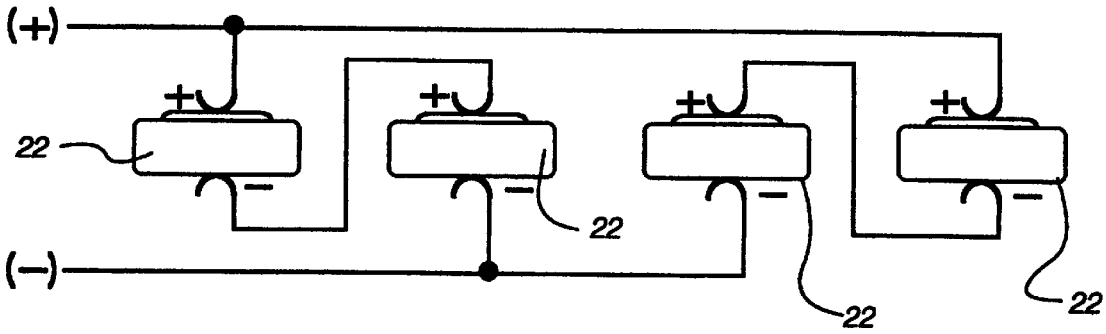
FIGS. 15–17 depict sample wiring schematics that are used in the preferred embodiment of the present invention.
Figure 16:
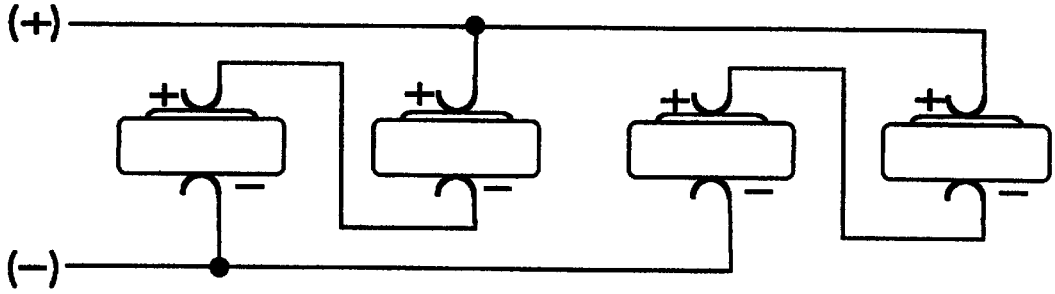
Figure 17:
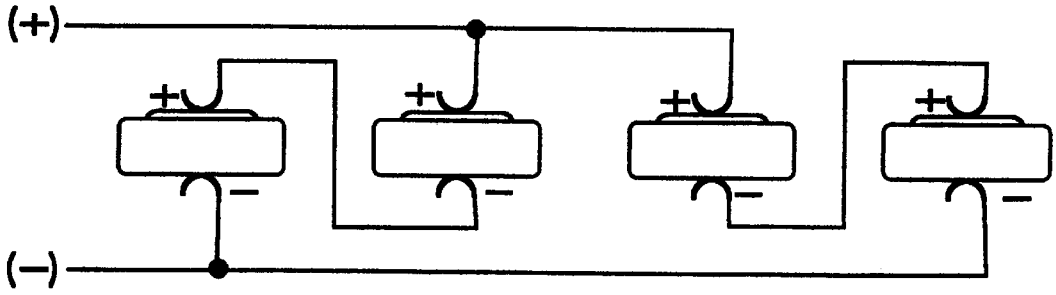

FIGS. 15–17 depict possible configurations for the electrical connections according to the preferred embodiment of the present invention. For example, if it is desirable for the first electrical lead 60 depicted in FIGS. 3–7, for example, to be positive, and the second electrical lead 64 to be negative, the electrical schematic shown in FIG. 15 represents the wiring arrangement depicted in FIGS. 3–7. If, on the other hand, it is desirable that the first electrical lead 60 be negative and the second electrical lead 64 be positive, the wiring schematic depicted in FIG. 17 represents the wiring connections of FIGS. 3–7. The common aspect of the three wiring schematics shown in FIGS. 15–17 is that two batteries 22 are connected in series, and the series pairs are then connected in parallel.

Although a preferred embodiment of this invention has been described above, those skilled in the art could make numerous alterations to the disclosed embodiment without departing from the spirit or scope of this invention. For example, more or fewer than four batteries could be accommodated by the system. Further, the electrical connections between the batteries may be altered depending upon the desired electrical characteristics. All directional references (e.g., upper, lower, upward, downward, left, right, leftward, rightward, top, bottom, above, below) above are only used for identification purposes to aid the reader's understanding of the present invention and do not create limitations, particularly as to position, orientation, or use of the invention. It is intended that all matter contained in the above description or shown in the accompanying drawings shall be interpreted as illustrative and not limiting.

We claim:

1. A system for holding a plurality of batteries, said system comprising a headrail that includes a headrail housing with a bottom wall and an elongated opening in said bottom wall;

a battery carrier housing having longitudinal ends and being adapted to be mounted to said headrail housing substantially in alignment with said elongated opening, wherein said battery carrier housing comprises a front wall, and wherein said front wall has at least two front carrier guides extending rearwardly therefrom, one of said at least two front carrier guides being adjacent to each of said longitudinal ends of said battery carrier housing;

a battery carrier having longitudinal ends and being removably mounted in said battery carrier housing, wherein said battery carrier further includes a plurality of battery ports, each battery port being adapted to retain one of the plurality of batteries; and a hanger positioned at each of said longitudinal ends of said battery carrier, each hanger being adapted to catch on said at least one front carrier guide adjacent to each of said longitudinal ends of said battery carrier housing, said hangers thereby being adapted to pivotally support said battery carrier about a longitudinal axis during installation and removal of batteries from said battery carrier.

2. The system of claim 1, wherein said battery carrier housing is removably mounted to said headrail housing.

3. The system of claim 1, wherein said battery ports are substantially circular and comprise circumferentially stair-stepped ledges.

4. The system of claim 1, wherein said battery carrier housing further comprises a rear wall, and wherein said rear wall has a corresponding rear carrier guide extending forwardly therefrom for each of said at least two front carrier guides, thereby defining a gap between each said front carrier guide and said corresponding rear carrier guide.

5. The system of claim 4, wherein each of said hangers at said longitudinal ends of said battery carrier is adapted to catch on both one of said at least two front carrier guides and said corresponding one of said rear carrier guides, said hangers thereby being adapted to pivotally support said battery carrier during installation and removal of batteries from said battery carrier.

6. The system of claim 4, wherein said battery carrier further comprises a rib at each of said longitudinal ends, wherein each said rib on said battery carrier is guided by one of said front carrier guides and said corresponding one of said rear carrier guides into said gap between said one of said front carrier guides and said corresponding one of said rear carrier guides.

7. The system if claim 6, wherein each said rib on said battery carrier has a lower end, and wherein a stop is present at each of said lower ends of said ribs to prevent said battery carrier from excessive insertion into said battery carrier housing.

8. The system of claim 4, wherein each of said at least two front carrier guides comprises an attached portion and a free, distal portion, wherein said distal portion of each of said front carrier guides comprises a sloped guide surface, wherein each of said sloped guide surfaces is adapted to guide one of said hangers into one of said gaps between one of said front carrier guides and said corresponding one of said rear carrier guides.

9. The system of claim 8, wherein each hanger further comprises a sloped upper surface adapted to pressingly engage one of said sloped guide surfaces on one of said free, distal portions of one of said at least two front carrier guides to facilitate removably mounting said battery carrier in said battery carrier housing.

10. The system of claim 1, wherein said longitudinal ends of said battery carrier further comprise upper edges, and wherein said hangers extend upwardly from said upper edges of said longitudinal ends of said battery carrier, each hanger being adapted to flex inwardly towards said other hanger to snap past said at least one front carrier guide adjacent to each of said longitudinal ends of said battery carrier housing during mounting of said battery carrier in said battery carrier housing.

11. The system of claim 1, wherein said battery carrier housing further comprises a pair of end walls, wherein each of said end walls has a retention groove on its upper edge, said system further comprising a carrier housing retainer ledge extending rearwardly from said front wall and a ridge extending downwardly from said retainer ledge, wherein said ridge engages said retention grooves when said battery carrier housing is fully mounted to said headrail housing.

12. The system of claim 11, wherein each of said end walls comprises a lower edge and further comprises an extended portion along said lower edge, wherein said extended portions extend into said elongated opening in said bottom wall of said headrail housing.

13. The system of claim 1, wherein said headrail housing further includes a front wall having a ledge extending rearwardly therefrom, and wherein said battery carrier has a lower edge and further comprises a retention foot along said lower edge, wherein said retention foot is adapted to ride on said ledge when said battery carrier is fully inserted into said battery carrier housing.

14. The system of claim 1, wherein said battery carrier comprises a longitudinal insertion edge extending between said longitudinal ends of said battery carrier, said longitudinal insertion edge being adapted to be inserted first into said battery carrier housing during installation of said battery carrier into said battery carrier housing, and wherein said longitudinal insertion edge comprises first and second longitudinal ends, each of said first and second longitudinal ends being adjacent to one of said longitudinal ends of said battery carrier, and further wherein each of said hangers is positioned adjacent to both one of said longitudinal ends of said battery carrier and one of said first and second longitudinal ends of said longitudinal insertion edge.

15. The system of claim 14, wherein each of said first and second longitudinal ends of said longitudinal insertion edge further comprises a notched region, and wherein each of said hangers is adapted to temporarily flex into and out of one of said notched regions as said battery carrier is inserted past said front carrier guides to removably mount said battery carrier in said battery carrier housing.

* * * * *